United States Patent [19]

D'Onofrio

[11] Patent Number: 4,630,165

[45] Date of Patent: Dec. 16, 1986

[54] D.C. POWER CONTROL FOR D.C. SOLENOID ACTUATORS

[75] Inventor: Anthony D'Onofrio, West Hartford, Conn.

[73] Assignee: Honeywell Inc., Minneapolis, Minn.

[21] Appl. No.: 786,377

[22] Filed: Oct. 10, 1985

[51] Int. Cl.[4] ..... H01H 47/22

[52] U.S. Cl. ..... 361/154; 361/194; 361/203

[58] Field of Search ..... 361/154, 194, 203

[56] References Cited

U.S. PATENT DOCUMENTS

| | | | |
|---|---|---|---|
| 3,579,052 | 5/1971 | Kato et al. | 361/203 X |
| 3,864,608 | 2/1975 | Normile et al. | 361/194 X |
| 4,327,394 | 4/1982 | Harper | 361/194 X |

*Primary Examiner*—Michael L. Gellner

*Attorney, Agent, or Firm*—Mitchell J. Halista; Trevor B. Joike

[57] ABSTRACT

A D.C. power control for a D.C. solenoid actuator which may be used for a D.C. solenoid operated valve uses a timer circuit for switching from an initial high pull-in power after a predetermined delay to a low hold power for the valve solenoid utilizing a pulse control where the valve "on" time is held constant and the "off" time is varied. The pulses are high frequency to prevent the valve from switching with each of the pulses while enabling the average current in the valve solenoid coil to be controlled independently between the pull-in and hold current values.

14 Claims, 2 Drawing Figures

INPUT
D.C.
SOLENOID COIL
TIMER
LM555
CURRENT
TIME
A
B

D.C. POWER CONTROL FOR D.C. SOLENOID ACTUATORS

BACKGROUND OF THE INVENTION

1. Field of the Invention

The present invention relates to solenoid actuators. More specifically, the present invention is directed to power control circuits for direct current solenoid valves.

2. Description of the Prior Art

Direct current (D.C.) operated solenoid valves have functional characteristics that make them unacceptable for long stroke applications. The power required for long stroke valves is very high for D.C. solenoid operators, and since with D.C. there is no impedance change from an open magnetic gap to a closed magnetic gap, the holding power is the same as the pull-in power. This produces thermal problems which can result in coil burnout. In order to enable the D.C. operated solenoid valves to be used successfully in long stroke applications, it is necessary to reduce or eliminate the thermal problem associated with the conventional long stroke D.C. operation while providing high current pull-in and low current hold in a cost effective package which could fit within the normal valve housing. Accordingly, it is desirable to provide a power management system for a D.C. valve operator solenoid to control the D.C. valve without the aforesaid problems.

SUMMARY OF THE INVENTION

An object of the present invention is to provide an improved D.C. power control circuit for a D.C. solenoid actuator.

Another object of the present invention is to provide an improved D.C. power control circuit for a D.C. valve operator solenoid.

In accomplishing these and other objects, there has been provided, a D.C. power control circuit having a source of high frequency pulses, circuit means for applying the pulses to an electromagnetic solenoid and means for reducing the number of pulses applied to the solenoid after an initial full number of pulse applications.

BRIEF DESCRIPTION OF THE DRAWINGS

A better understanding of the present invention may be had when the following detailed description is read in connection with the accompanying drawings, in which.

DESCRIPTION OF THE PREFERRED EMBODIMENT

Figures 1, 2:
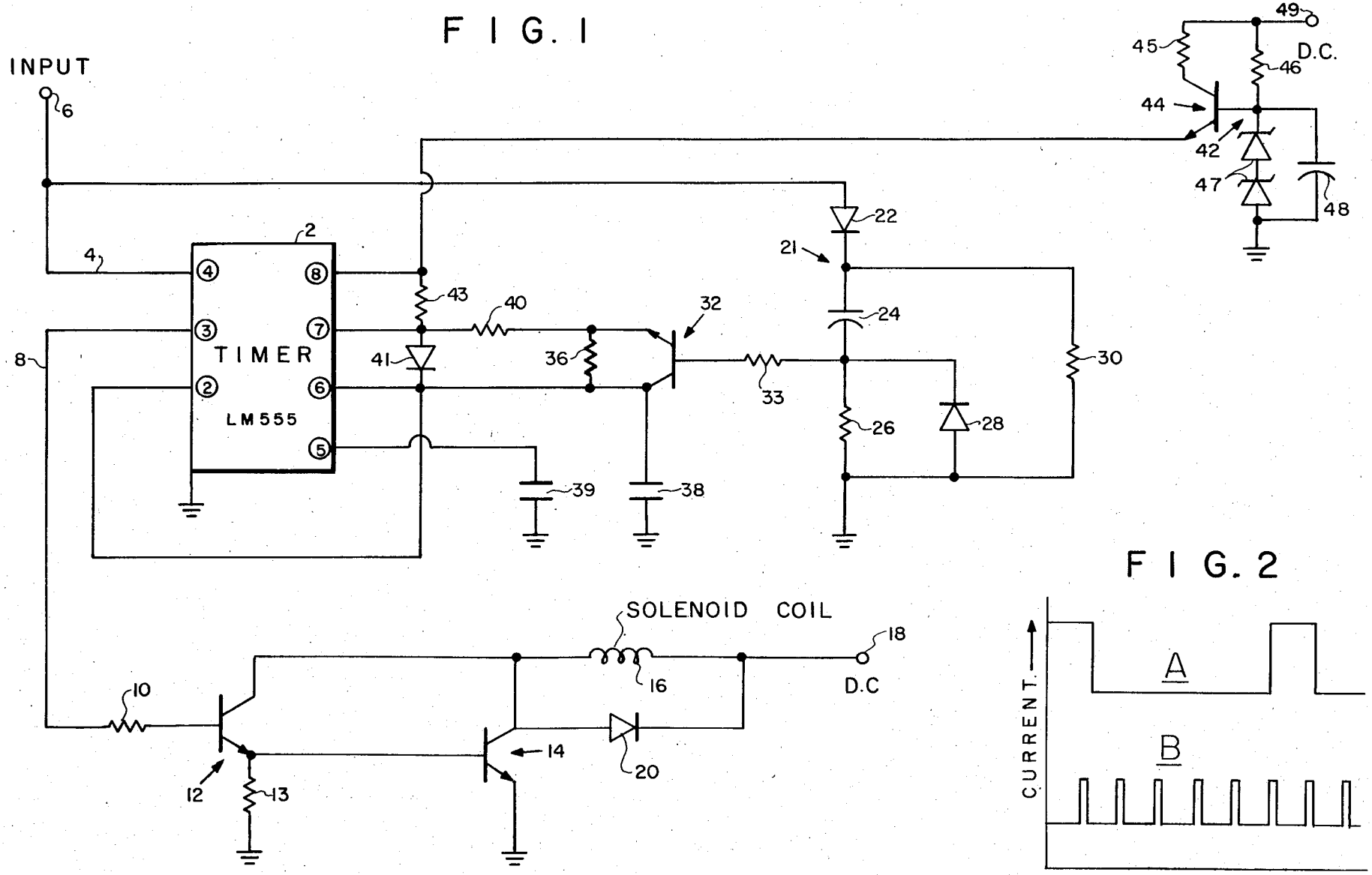
FIG. 1 is shown a schematic illustration of an example of a D.C. power control circuit for a D.C. valve embodiment of the present invention
FIG. 2 is a waveshape diagram showing the high and low current operation of the output of the circuit shown in FIG. 1.

Referring to FIG. 1 in more detail, there is shown a timer 2 having a control input " 4 " connected via line 4 to a control signal input terminal 6. An output line 8 from the output terminal " 3 " of the timer 2 is connected through a first resistor 10 to a Darlington amplifier having a pair of transistors 12 and 14 and a second resistor 13. The D.C. solenoid coil 16 for a solenoid valve (not shown) is connected between the output collector of the Darlington amplifier and a direct current voltage terminal 18. A first diode 20 is connected across the solenoid coil 16 to maintain the current flow in one direction for the solenoid coil 16 whereby any backward current would be bypassed by the diode 20 which functions as a suppressor. A delay or timing circuit 21 includes a second diode 22 having one side connected to the control input terminal 6 and a second side connected to one side of a first capacitor 24. The other side of the first capacitor 24 is connected through a third resistor 26 to a common ground connection. A third diode 28 is arranged to provide a bypass for the second resistor 26. Concurrently, a fourth resistor 30 is connected from the second side of the diode 22 to the common ground connection.

The timing circuit 21 comprising the first capacitor 24, the second diode 28 and the second and third resistors 26, 30 forms a signal delay circuit which determines when a third transistor 32 is switched to a low power mode of operation. Specifically, the junction between the capacitor 24 and the resistor 26 is connected through a fifth resistor 33 to the base electrode input of the third transistor 32. A sixth resistor 36 is connected across the emitter and collector electrodes of the third transistor 32 while the collector electrode is connected through a second capacitor 38 to a common ground connection. The emitter of the third transistor 32 is connected through a sixth resistor 40 to the " 7 " input of the timer 2 while the collector electrode is connected directly to the " 6 " input of the timer 2. A third diode 41 is also connected across the " 6 " and " 7 " inputs of the timer 2. The " 5 " terminal of the timer 2 is connected to ground through a third capacitor 39 while the " 2 " terminal is connected to " 6 " terminal. The power input terminal " 8 " of the timer 2 is connected to a D.C. power regulating circuit 42 through a seventh resistor 43. The power regulating circuit 42 includes a fourth transistor 44, an eighth resistor 45, a ninth resistor 46, a voltage limiting Zener diodes 47 and a fourth capacitor 48. A D.C. power input terminal 49 is connected to a source of D.C. power (not shown) which is regulated by the regulating circuit 42 and applied to the timer 2 and the solenoid coil power terminal 18.

In operation, the circuit of the present invention is effective to provide a high pull-in current which is the average of the output pulses from the timer 2. Specifically, when the control input signal applied to the control terminal 6 goes "high", e.g., 5 volts, the third transistor 32 and the timer 2 are turned "on". The timer 2 now runs as a free-running multivibrator producing a high frequency, e.g., 2 kHz, output which drives the Darlington amplifier consisting of the first and second transistors 12,14 whereby the average current through the solenoid coil 16 is controlled by the pulses applied to the first transistor 12. The timing circuit 21 will determine when the third transistor 32 is turned "off" to switch the average current to the low power, or hold, mode. Thus, when the valve "off" time is increased, the average current in the coil 16 will decrease to the "hold" value. On the other hand, when the valve is turned "on", i.e., during the pull-in current value, the "off" time is very short.

After a suitable delay time of approximately two times the "pull-in" time, e.g., 4 to 100 millisecond, the power to the coil is switched to the low power or "hold-in" mode. Specifically, as the first capacitor 24 charges up from the input terminal 6 through the diode 22, the third transistor 32 is eventually turned "off".

The voltage drop across the resistor 36 is now effective to determine the holding current, i.e., the valve "off" time. The free running frequency of the timer 2 is selected to be high enough, to eliminate the switching of the valve from "on" to "off" with the output pulses from the timer 2. Thus, the average current and therefore the average power to the valve is controlled. The high and low power current outputs are shown in the waveshape diagram of FIG. 2., i.e., waveshape A illustrating the low power operating mode and waveshape B illustrating the high power operating mode.

Accordingly, a D.C. operated solenoid valve can be used in a power control circuit for extending the pressure/flow requirements to reduce the powe supplied to the solenoid operator and/or to provide a universal type valve whose operating characteristics can be selected by the power control circuit. With the control circuit, power management optimization is realizable, and a direct microprocessor interface can be provided as a one gate load for operating the timer 2. Further, overheating and/or burnout of the solenoid coil 16 is eliminated, e.g., pull-in power can be 14 watts while a comparable hold-in power would be 380 milliwatts whereby power supply requirements are drastically reduced. Finally, it should be noted that while the present invention has been presented in the context of a D.C. valve solenoid operating circuit, the present invention is obviously applicable to other D.C. operated electromagnetic circuits which can operate between high and low power modes, e.g., electromagnetic relays.

The following is a detailed list of the circuit components used in a preferred construction of the illustrated example of the present invention as shown in the single figure drawing:

| | |
|---|---|
| Timer | Motorola Type LM555 |
| Transistor 32,44 | 2N3904 |
| Transistor 12 | MPSU45 |
| Transistor 14 | 2N5655 |
| Diodes 22,41 | IN914 |
| Diodes 20,28 | IN4006 |
| Diodes 42 | IN5239 |
| Resistor 10 | IK |
| Resistors 13,45 | 100 |
| Resistor 26 | Selected for Valve |
| Resistor 30 | 27K |
| Resistor 33 | 68K |
| Resistor 36 | Selected for Valve |
| Resistor 40 | 4.1K |
| Resistor 43 | 3.22K |
| Resistor 46 | 1.8K |
| Capacitor 24 | 1 μf |
| Capacitors 38,39 | .001 μf |
| Capacitor 48 | .47 μf |

Accordingly, it may be seen that there has been provided, in accordance with the present invention, an improved D.C. power control circuit for a D.C. solenoid operator.

The embodiments of the present invention in which an exclusive property or privilege is claimed are defined as follows:

1. A D.C. power control circuit comprising means for selectively providing a sequence of high frequency current pulses, circuit means for applying the pulses to a D.C. operated electromagnetic solenoid and means for reducing the number of pulses applied to the solenoid after an initial full number of pulse applications during a predetermined time interval.

2. A control circuit as set forth in claim 1 wherein said means for providing includes a free-running oscillator means.

3. A control circuit as set forth in claim 1 wherein the pulse sequence has a frequency of 2 kHz.

4. A control circuit as set forth in claim 1 wherein said time interval is approximately two times the pull-in time of the solenoid.

5. A control circuit as set forth in claim 1 wherein said means for providing includes an oscillator means and said means for reducing includes means for interrupting the operation of said source to eliminate a predetermined number of the pulses from said source.

6. A control circuit as set forth in claim 1 wherein said means for providing includes input means responsive to an input control signal for initiating the high frequency pulses.

7. A D.C. power control circuit for a solenoid operated D.C. valve comprising means for selectively providing a sequence of high frequency current pulses, a D.C. solenoid coil for operating a valve, circuit means for applying the pulses to said solenoid coil and means for reducing the number of pulses applied to the solenoid after an initial full number of pulse applications during a predetermined time interval.

8. A control circuit as set forth in claim 7 wherein said means for providing includes a free-running oscillator means.

9. A control circuit as set forth in claim 7 wherein the pulse sequence has a frequency of 2 kHz.

10. A control circuit as set forth in claim 7 wherein said time interval is approximately two times the pull-in time of the solenoid.

11. A control circuit as set forth in claim 7 wherein said means for providing includes an oscillator means and said means for reducing includes means for interrupting the operation of said source to eliminate a predetermined number of the pulses from said source.

12. A control circuit as set forth in claim 7 wherein said means for providing includes input means responsive to an input control signal for initiating the high frequency pulses.

13. A method for supplying D.C. power to an electromagnetic solenoid actuator including the steps of initially supplying a number of D.C. current pulses to the actuator and after a predetermined time interval reducing the number of pulses applied to the solenoid.

14. A method for applying D.C. power to a solenoid operated D.C. valve including the steps of initially supplying a number of D.C. current pulses to the solenoid operator of the D.C. valve and after a predetermined time interval reducing the number of pulses applied to the solenoid operator.

* * * * *